US005198827A

United States Patent [19]

Seaton

[11] Patent Number: 5,198,827

[45] Date of Patent: Mar. 30, 1993

[54] DUAL REFLECTOR SCANNING ANTENNA SYSTEM

[75] Inventor: Arthur F. Seaton, Palos Verdes, Calif.

[73] Assignee: Hughes Aircraft Company, Los Angeles, Calif.

[21] Appl. No.: 712,175

[22] Filed: May 23, 1991

[51] Int. Cl.[5] ..... H01Q 3/20

[52] U.S. Cl. ..... 343/761; 343/781 CA; 343/779; 343/839

[58] Field of Search ..... 343/761, 779, 781 P, 343/781 CA, 839, 840

[56] References Cited

U.S. PATENT DOCUMENTS

| | | | |
|---|---|---|---|
| 3,696,432 | 10/1972 | Anderson et al. | 343/761 |
| 3,745,582 | 7/1973 | Karikomi et al. | 343/839 |
| 4,274,098 | 6/1981 | Renau et al. | 343/781 CA |
| 4,305,075 | 12/1981 | Salvat et al. | 343/781 CA |
| 4,668,955 | 5/1987 | Smoll | 343/761 |

OTHER PUBLICATIONS

Masahiro Karikomi, "A Limited Steerable Dual Reflector Antenna", Electronics and Communications in Japan, vol. 55B, No. 10, 1972, pp. 62–68.

Scheiner et al., "Multifrequency High-Power Cassegrainian Antenna-Feed System for Satellite Ground Stations", Electrical Communication, vol. 39, No. 1, 1964, pp. 73–77.

*Primary Examiner*—Michael C. Wimer
*Assistant Examiner*—Tan Ho
*Attorney, Agent, or Firm*—L. A. Alkov; W. K. Denson-Low

[57] ABSTRACT

A fixed feed dual reflector scanning antenna system 10 having a low moment of inertia is disclosed herein. The inventive dual reflector antenna system 10 includes an antenna feed structure 16 for emitting electromagnetic radiation. The antenna system 10 further includes a subreflector 12 for redirecting the emitted radiation. The subreflector 12 is intersected by a subreflector longitudinal axis $L_s$ at a rotation point proximate a vertex 20 of the subreflector 12. A main antenna reflector 14 circumscribing a main longitudinal axis $L_m$ projects radiation redirected by the subreflector 12 as an antenna beam. A mechanical arrangement 22 rotates the subreflector 12 about the rotation point so as to vary the angular orientation between the subreflector longitudinal axis $L_s$ and the main longitudinal axis $L_m$. In this manner the antenna beam is scanned relative to the main longitudinal axis $L_m$.

6 Claims, 3 Drawing Sheets

DUAL REFLECTOR SCANNING ANTENNA SYSTEM

BACKGROUND OF THE INVENTION

1. Field of the Invention

This invention relates to scanning antennas. More specifically, this invention relates to dual reflector scanning antenna arrangements.

While the present invention is described herein with reference to a particular embodiment, it is understood that the invention is not limited thereto. Those having ordinary skill in the art and access to the teachings provided herein will recognize additional embodiments within the scope thereof.

2. Description of the Related Art

Antenna arrangements for scanning a beam in a single dimension across a field-of-view are currently used in a variety of applications, including satellite communication and automotive radar. In perhaps the simplest scanning arrangements an antenna assembly is rapidly rotated through a beam scan angle defining the field-of-view. Unfortunately, such single antenna systems typically manifest a relatively high moment of inertia, and hence require a rugged and powerful rotary joint drive mechanism to effect scanning at a sufficiently high rate. In addition, rotating an entire antenna having a high moment of inertia throughout a field-of-view may induce substantial vibration—a clearly undesirable phenomenon in the presence of other sensitive hardware.

Dual reflector antenna systems constitute an alternative means of effecting linear scanning of an antenna beam. In dual reflector systems, an antenna feed emits radiation which is reflected by a subreflector to a main reflector. The main reflector then projects the incident radiation from the subreflector as an antenna beam. The beam is then scanned over the field-of-view by translating the antenna feed relative to the subreflector.

In Cassegrainian dual reflector systems each reflector is constrained to be symmetrical about its own centerline, with the main reflector defining a paraboloid and the subreflector defining a hyperboloid. However, Cassegrainian systems having purely conic (paraboloid and hyperboloid) reflectors engender coma aberration (i.e. the appearance of particular sidelobes in the scanned antenna beam pattern as the antenna feed is moved back and forth).

Certain dual element antennas utilizing reflectors which depart from strictly conic surfaces have been devised to minimize coma and spherical aberration. For example, in Schwarzschild antennas the paraboloid and hyperboloid surfaces of a Cassegrainian antenna are perturbed in order to reduce the magnitude of coma lobes in the antenna pattern. A limited beam scan may be obtained using a Schwarzschild system by moving the antenna feed back and forth through a region of space approximating a focal plane. However, conventional Schwarzschild systems are not disposed to project a scanned antenna beam from a fixed feed location. Thus, Schwarzschild systems require a complex rotary joint mechanism to enable translation of the antenna feed.

In a particular dual element system disclosed by C. A. Rappaport, "An Offset Bifocal Reflector Antenna Design for Wide-Angle Beam Scanning", *IEEE Transactions on Antennas and Propagation.* Vol. AP-32, No. 11, Nov. 1984, pp. 1196–1204, both reflectors are fixed and are specially shaped to produce a pair of focal points.

However, in order to utilize the system of Rappaport to generate a scanned beam the antenna feed would again need to be moved relative to the subreflector. In the Rappaport system this translation would occur along the contour of best focus between the focal points, and would be required to take place over an angle larger than the beam scan angle. A further disadvantage of the dual element arrangement disclosed by Rappaport is that a rotary joint would again need to be used to displace the antenna feed throughout the focal plane. Moreover, the translated feed assembly may also possess a moment of inertia of sufficient magnitude to cause undesired vibration.

Accordingly, a need in the art exists for a dual reflector antenna system having a scanning element characterized by a low moment of inertia, in which the scanning element is not required to scan an angle as large as the beam scan angle.

SUMMARY OF THE INVENTION

The need in the art for a scanning antenna apparatus having a low moment of inertia is addressed by the fixed feed dual reflector scanning antenna system of the present invention. The inventive dual reflector antenna includes an antenna feed structure for emitting electromagnetic radiation. The antenna system of the present invention further includes a subreflector for redirecting the emitted radiation toward a main reflector. The main antenna reflector projects radiation redirected by the subreflector as an antenna beam. A mechanical arrangement rotates the subreflector about a rotation point so as to vary the angular orientation between the subreflector longitudinal axis and the main longitudinal axis. In this manner the antenna beam is scanned relative to the main longitudinal axis with minimal motion of the feed structure.

DETAILED DESCRIPTION OF THE INVENTION

Figure 1:
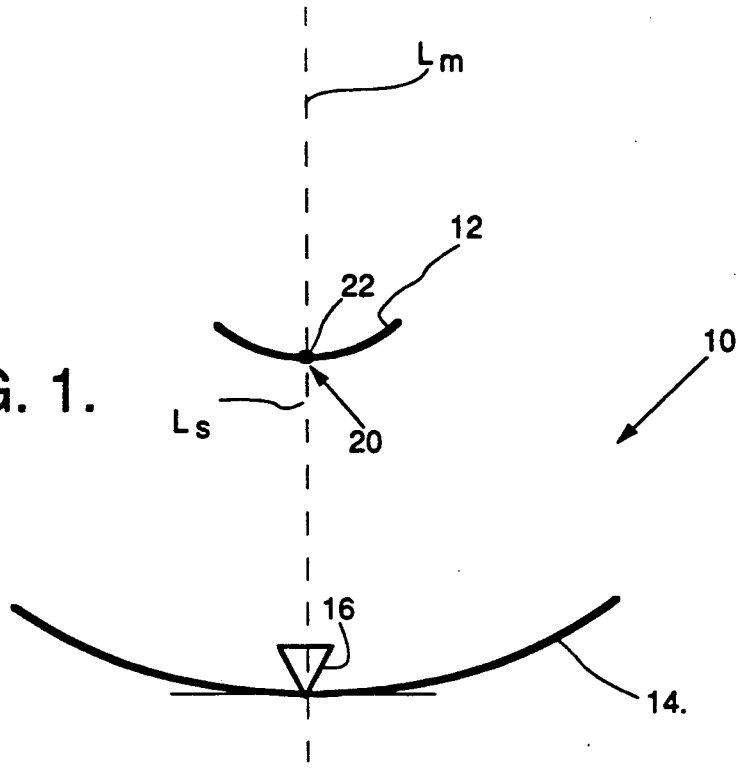
FIG. 1 is a simplified schematic diagram of the fixed feed dual reflector scanning antenna system of the present invention.

FIG. 1 shows a simplified schematic diagram of the fixed feed dual reflector scanning antenna system 10 of the present invention. The inventive antenna system 10 includes a subreflector 12 and a main reflector 14 which circumscribes a longitudinal axis $L_m$ therethrough. The subreflector 12 and the main reflector 14 may be of conventional construction. A conventional antenna feed 16 positioned on the axis $L_m$ is oriented to emit electromagnetic energy about the axis $L_m$. The emitted radiation is reflected by the subreflector 12 to the main reflector 14, which projects the energy reflected by the subreflector 12 as an antenna beam.

In contrast to the conventional dual reflector systems described in the Background of the Invention, the inventive system 10 effects beam scanning in the plane of FIG. 1 through rotation of the subreflector 12 about a rotation point on a subreflector longitudinal axis $L_s$ at or near (i.e. proximate) a subreflector vertex 20. In this manner the antenna system 10 projects a scanning antenna beam through a selected scan angle without moving the antenna feed 16 from a fixed position on the axis $L_m$.

Although a symmetrical embodiment of the inventive antenna system 10 (antenna feed 16 located on the axis $L_m$) is depicted in FIG. 1 in order to facilitate explanation, the teachings of the present invention are also applicable to offset geometries wherein the feed 16 is positioned at a fixed location not intersected by the axis $L_m$.

As described hereinafter, the shapes of the subreflector 12 and main reflector 14 are designed to be symmetrical about the axis $L_m$ when the axes $L_s$ and $L_m$ are coincident as depicted in FIG. 1. In addition, the subreflector 12 and main reflector 14 will typically not constitute pure conic surfaces. In accordance with the present teachings, these surfaces are specially shaped such that the system 10 effects a sharp focus at the location of the antenna feed 16 for a pair of symmetrical scan orientations of the subreflector 12 relative to the main reflector 14. When a sharp focus is created at the feed 16, the inventive system 10 is operative to project an antenna beam having a substantially planar wavefront (i.e. a well-focused scanning beam).

Figure 2:
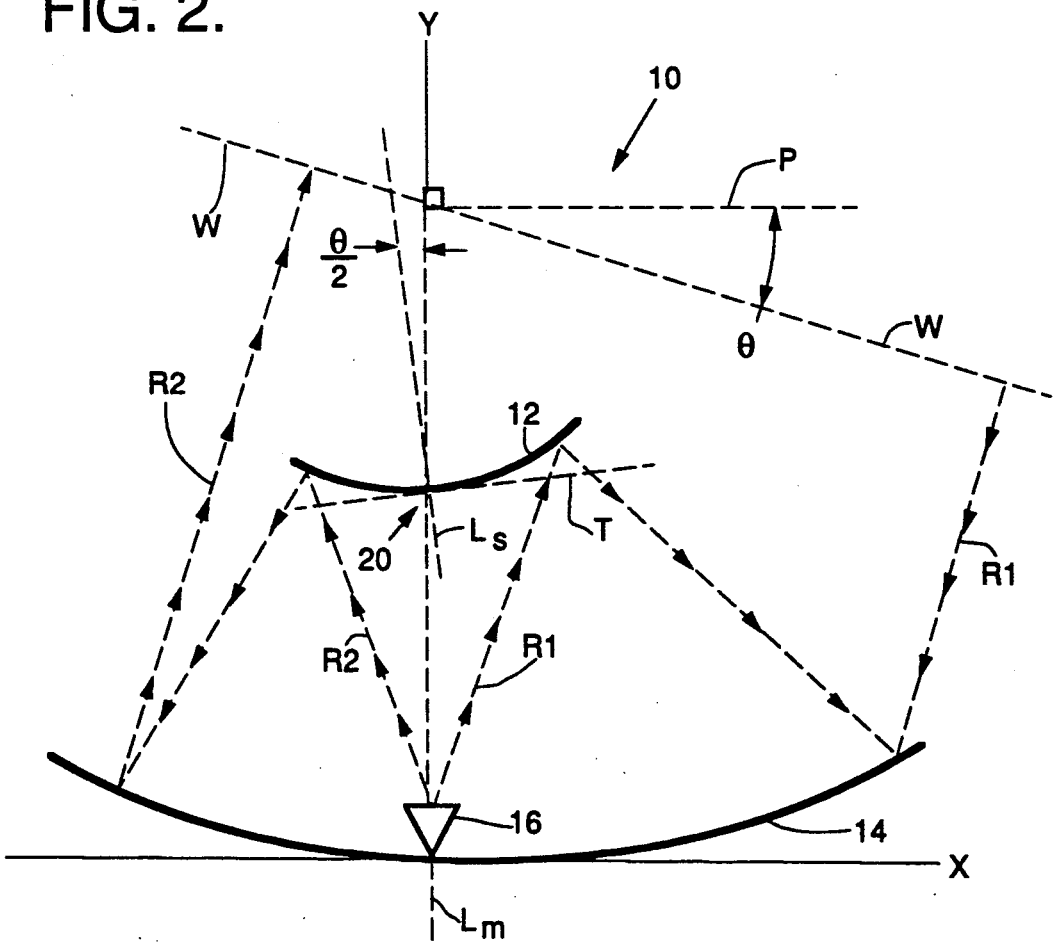
FIG. 2 is a schematic diagram of the inventive scanning antenna system showing the angular orientation of a subreflector longitudinal axis $L_s$ relative to a wavefront W projected to the right.
Figure 3:
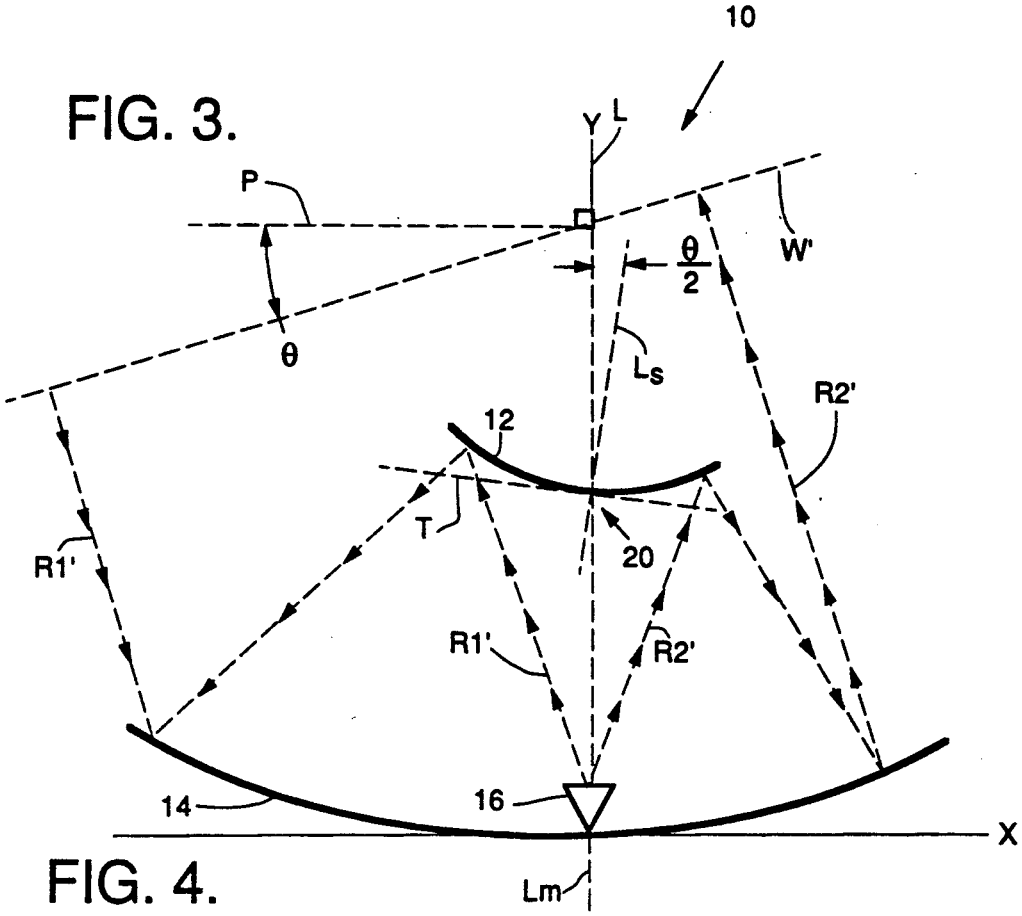
FIG. 3 is a schematic diagram of the inventive scanning antenna system showing the angular orientation of the subreflector longitudinal axis $L_s$ relative to a wavefront W' projected to the left.

FIGS. 2 and 3 depict a pair of symmetrical orientations of the subreflector 12 relative to the main reflector 14 for which a sharp focus at the feed 16 is attained. As shown in FIG. 2, the longitudinal axis $L_s$ perpendicularly intersects a tangent T of the subreflector vertex 20 (or a rotation point proximate thereto) to form a one-half scan angle $\Theta/2$ with the longitudinal axis $L_m$. This $\Theta/2$ angular orientation of the subreflector 12 results in a substantially planar wavefront W being projected by the antenna system 10. The wavefront W forms a scan angle $\Theta$ with a perpendicular P to the main reflector longitudinal axis $L_m$ for the subreflector orientation $\Theta/2$. Rays R1 and R2 are representative of the equal path length radiation emitted by the antenna feed 16, and reflected by the reflectors 12 and 14, which forms the planar wavefront W. Assuming the $\Theta/2$ angular orientation of the subreflector 12, substantially all radiation emitted at a first instant in time by the feed 16 and redirected by the reflectors 12 and 14 will arrive at the wavefront W at an identical later time. In FIG. 2, the subreflector 12 is oriented to steer the beam defined by the wavefront W to the right relative to the axis $L_m$.

FIG. 3 is the mirror image of FIG. 2. In FIG. 3, the subreflector 12 is oriented at an angle of $\Theta/2$ to steer the beam to the left. Again, the $\Theta/2$ angular orientation of the subreflector 12 results in projection of a planar wavefront W'. The wavefront W' forms a scan angle $\Theta$ with a perpendicular P to the main reflector longitudinal axis $L_m$. In accordance with the design teaching provided herein, the reflectors 12 and 14 are shaped such that all rays R1' and R2' originating within the feed 16 traverse paths of equal length to the wavefront W' for a subreflector scan angle of $\Theta/2$. The symmetrical orientations of the subreflector 12 which result in a sharp focus being created at the antenna feed 16 (i.e. subreflector scan angles of $+/-\ \Theta/2$ degrees) are chosen such that the projected antenna beam retains a substantially planar wavefront for subreflector scan angles therebetween. It is anticipated that a wavefront suitably planar for many scanning operations will be produced over a range of subreflector scan angles ($\Theta/2$) of $+/-$ five 3dB beamwidths of the far field pattern ($\Theta = +/-$ ten 3dB beamwidths).

Inspection of FIGS. 2 and 3 reveals that rotation of the subreflector longitudinal axis $L_s$ through an angle $\Theta$ centered about the axis $L_m$ results in scanning of the projected antenna beam through an angle of $2\Theta$. This feature of the present invention contrasts with the scanning characteristics of conventional dual reflector systems, wherein a feed element typically must be displaced through an angle at least as large as that subtended by the scanning antenna beam. In addition, the subreflector 12 may be fabricated to have a relatively low moment of inertia. As a consequence, the weight, power consumption and vibration of the antenna system 10 may be minimized. Moreover, a conventional bearing apparatus and associated drive mechanism 22 (FIG. 1) may be used to rotate the subreflector through the angle $\Theta$, thus obviating the need for a complex rotary joint. Ideally, the bearing 22 would be located at or near the vertex 20 so that the rotation of the subreflector 12 would not involve any linear translation thereof.

In the context of, for example, an automotive radar system operative at approximately 60 GHz the mechanism 22 could be designed to drive a subreflector in order to provide a stepping beam over a relatively small angle. In such a system the dimensions of the subreflector could generally be made be as small as two to three inches. Accordingly, stepwise scanning could be effecutated by mounting the subreflector onto the shaft of small stepping motor.

Similarly, meterological radar systems deployed on commercial aircraft typically require a relatively small scanning angle. However, in certain weather radar systems a subreflector having dimensions in excess of two to three inches is required. Suitable drive mechanism for these systems would typically include a set of bearings for rotating a subreflector scan axle. A continuously operating motor with a mechanical linkage could be used to repetitively scan the subreflector through a limited angle.

As mentioned above, the subreflector 12 is symmetrical about the longitudinal axis $L_s$ and the reflector 14 is symmetrical about the longitudinal axis $L_m$ thereof. This allows the optimal shapes of the reflectors 12 and 14 to be determined with respect to the steering of the beam in one of the directions depicted in FIG. 2 or FIG. 3. Although the antenna 10 will be physically realized in three dimensions, the shaping thereof is largely a two-dimensional problem given that the subreflector is preferably scanned in only a single plane. Hence, a two-dimensional solution will initially be sought—with the result subsequently being extended to three-dimensions in the manner described below. A computer-aided technique described will allow determination of the contours of the reflectors 12 and 14. This computer-aided technique will be described with reference to a ray tracing or scattering program such as RAYTRACE.-FORT, which will preferably be used in conjunction with a FORTRAN program such as the ZXSSQ optimization routine included within the IMSL library.

As a starting point in the determination of the reflector contours of the inventive antenna system 10, a conventional Cassegrain antenna would be designed to project a beam parallel to the main reflector axis $L_m$. The Cassegrain antenna would be designed such that the straight-ahead beam projected thereby would have a cross-section and intensity substantially equivalent to that desired in the scanned beam produced by the present invention. Again, the main reflector and the subreflector in a conventional Cassegrain antenna consist of a paraboloid and a hyperboloid, respectively.

Figure 4:
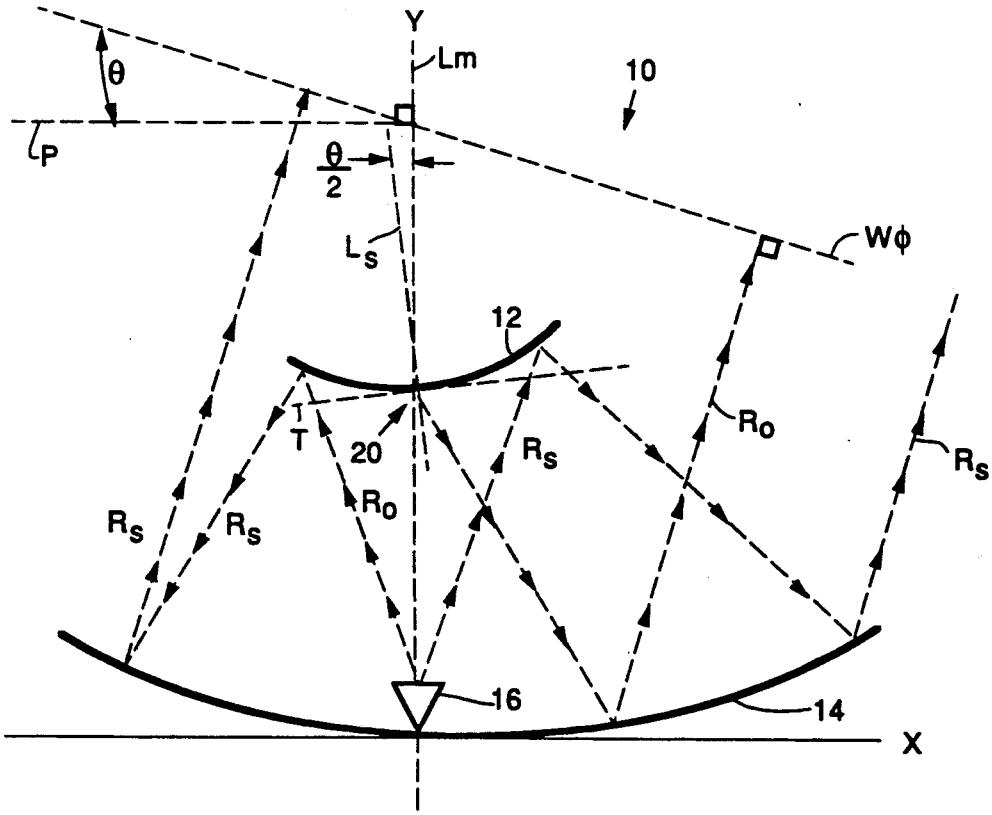
FIG. 4 is a schematic diagram showing a central ray $R_o$ and sample rays $R_s$ used in computing an error function associated with the shapes of the reflecting surfaces included within the inventive antenna system of the present invention.

The next step in the synthesis of the inventive antenna system is to appropriately deform the surface contours of the Cassegrain antenna designed above in the plane in which the projected beam is scanned (i.e. in the X-Y plane shown in FIGS. 2 and 3). The object of this deformation is to shape the reflectors 12 and 14 in the scanning plane such that the rays in this plane form a planar wavefront when the subreflector is oriented at scan angles of $+/-\Theta/2$. Due to the symmetry of the reflectors, only the case in which the antenna beam is steered $\Theta$ degrees to the right due to rotation of the subreflector $\Theta/2$ degrees to the left need be considered. This configuration is shown in the schematic diagram of FIG. 4, in which a central ray $R_o$ impinges on the vertex 20 of the subreflector 12. A point along the central ray $R_o$ in the near field of the antenna 10 is selected as the desired location of a planar wavefront $W_o$. The wavefront $W_o$ is constructed by drawing the perpendicular to the selected location on the central ray $R_o$. The length of the central ray $R_o$ between the feed 16 and the wavefront $W_o$ is then computed and is established as the reference path length. An error function for the optimization routine utilized (called by the ray tracing program) is generated by calculating the path lengths for a large number of sample rays $R_s$ emanating from the feed and comparing them to the central ray $R_o$. The differences between the path lengths of these sample rays and the reference path lengths are squared and summed to produce a total error function.

In order to obtain a more refined approximation for the geometry of the reflectors in the scanning plane the error function may be weighted to account for nonuniformity in the distribution of radiation over the reflectors 12 and 14. In particular, the specific type of structure selected to serve as the antenna feed 16 affects this radiative energy distribution. For example, a rectangular waveguide horn may be selected to serve as the antenna feed 16 in applications wherein it is desired to minimize side lobes by reducing the radiation incident on the edges of the reflectors 12 and 14. It follows that in such a system, rays impinging on the center portions of the reflectors 12 and 14 should be weighted more heavily than those illuminating the periphery.

Figure 5:
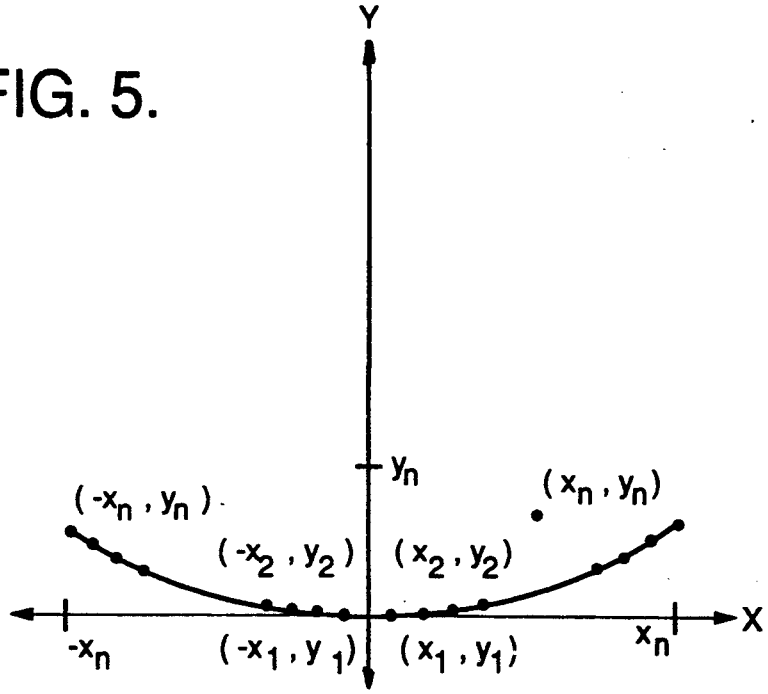
FIG. 5 is a schematic diagram of a central section surface contour of the main reflector included within the present invention in an X-Y coordinate system.
Figure 6:
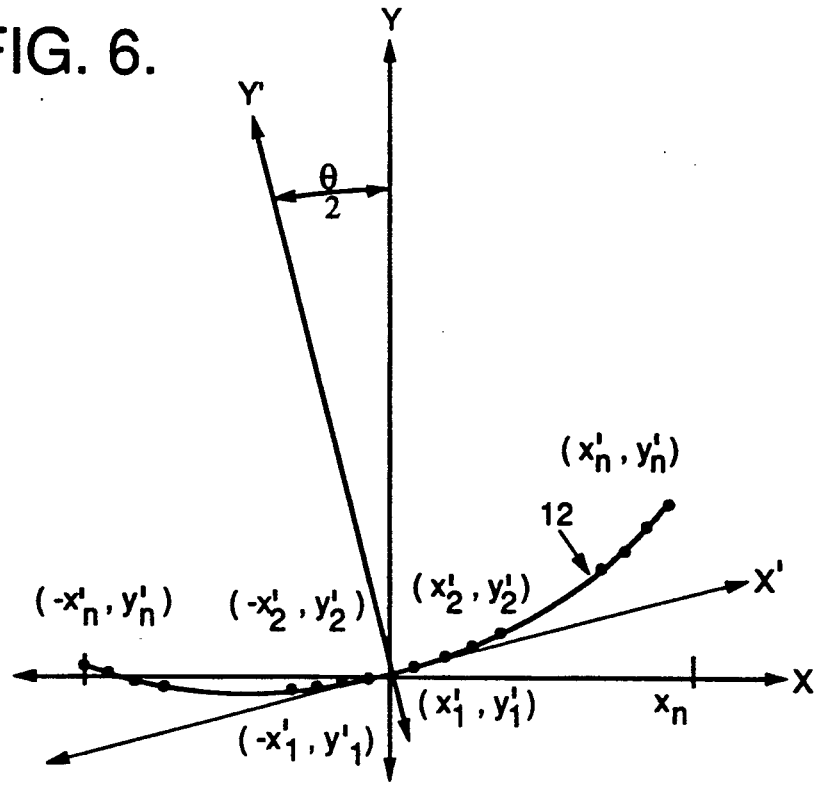
FIG. 6 is a schematic diagram of a central section surface contour of the subreflector of the present invention in an X'-Y' coordinate system wherein the X'-Y' plane is rotated at a scan angle $\Theta/2$ relative to the X-Y plane.

The surface contours of the subreflector 12 and the main reflector 14 are input to the selected ray tracing program as a series of (x,y) coordinates. As shown in FIG. 5, coordinates of the main reflector 14 are entered as values in an X-Y plane. The coordinates for the surface contours of the subreflector 12 are submitted as values in a rotated X'-Y' plane depicted in FIG. 6. Z and Z' axes (not shown) will exist perpendicular to the X-Y and X'-Y' coordinate planes, respectively. The ray tracing program transforms the X'-Y' coordinates for the subreflector 12 into X-Y coordinate values such that the error function may be correctly computed. Lagrangian interpolation is performed as necessary by the optimization routine called by the ray tracing program to obtain coordinates between the coordinates initially submitted. The optimization routine is operative to adjust the 'y' coordinate value associated with each specified and interpolated point on the right half of each of the reflectors 12 and 14. As noted above, each of the reflectors 12 and 14 is symmetrical about the vertex thereof. Thus, the ray tracing program adjusts the 'y' value on the left side of one of the reflectors 12 and 14 whenever an identical adjustment in the corresponding 'y' value on the right side of that reflector is called for and by an identical amount.

Upon each adjustment of a set of 'y' values, the ray tracing program computes the error function and communicates this new value to the optimization routine. This iterative procedure is repeated until the error function is reduced to a predetermined level, and is then terminated. As noted above, the ray tracing program yields the contours of the reflectors 12 and 14 in the plane in which the beam projected by the inventive antenna system is linearly scanned. These derived contours will hereinafter be referred to as the central section curves of the main and subreflectors, respectively.

Next, a three-dimensional approximation of the antenna system of the present invention is formulated utilizing the central section curves. A three-dimensional representation of the main reflector 14 is synthesized by combining a plurality of parabolic contours with the central section curve thereof. In addition, a three-dimensional representation of the subreflector 12 may be created by combining a plurality of hyperbolic contours with the subreflector central section curve. The supplemental parabolic contours will exist in planes parallel to the Y-Z plane, and the hyperbolic contours will exist in planes parallel to the Y'-Z' plane. The vertices of the parabolic contours will coincide with appropriate points on the central section curve of the main reflector such that the tangents to these points will be parallel to the Z-axis. Similarly, the vertices of the hyperbolic contours will coincide with appropriate points on the central section curve of the subreflector such that the tangents to these vertices will be parallel to the Z'axis.

The coordinates of the three-dimensional representations of the reflectors 12 and 14 may then be entered into, for example, a FORTRAN reflector program such as MULTIPLE.REFLECTR.FORT capable of calculating far-field antenna patterns. The number of parabolic/hyperbolic contours to be derived will depend upon the degree of accuracy desired in the computer-generated far-field antenna patterns. To the extent the approximated far-field patterns differ appreciably from those desired, it may be elected to deform the three-dimensional approximations of the reflectors 12 and 14 using an optimization procedure substantially similar to that used to derive the central section curves of the reflectors 12 and 14. A scattering or ray tracing program such as RAYTRCE.FORT capable of three-dimensional analysis would be employed.

As was described above with respect to optimization of the two-dimensional contours of the reflectors 12 and 14, the first step in performing a three-dimensional optimization procedure is to enter the three-dimensional coordinates of the main reflector from an X-Y-Z coordinate system. Next, the three-dimensional coordinates of the subreflector are entered from an X'-Y'-Z' coordinate system. The Z and Z' directions are chosen to be parallel, but the orientations of the X-Y and X'-Y' planes are selected to differ by the maximum subreflector scan angle of $\Theta/2$. Again, each parabolic or hyperbolic cross-section is constrained to be symmetrical about the vertex thereof. Thus, optimization need only be performed over a single half of each of the three-dimensional approximations to the surfaces of the reflectors.

As in the two-dimensional case, an error function weighted in accordance with the particular antenna feed utilized is formulated. In constructing the error function, a central ray impinging on the vertex of the subreflector from the antenna feed is again drawn to a desired wavefront location in the near antenna field. The planar surface normal to the central ray at the selected point in the near field defines the desired planar wavefront engendered by the antenna. The error function corresponds to the sum of the squares of the path length differences to this plane which exist between the central ray and a number of appropriately chosen sample rays emanating from the antenna feed in three-dimensional space. The ray tracing program then modifies the approximations of the reflector surfaces until the error function is reduced to a predetermined value, thus producing a sharp focus at the antenna feed. Because of symmetry considerations the antenna system will then also exhibit a sharp focus when the subreflector is scanned in the opposit direction to an angle of $-\Theta/2$. The resultant three-dimensional representation of the main reflector and subreflector may then be used to fabricate a physical embodiment of the dual reflector antenna system of the present invention.

Thus the present invention has been described with reference to a particular embodiment in connection with a particular application. Those having ordinary skill in the art and access to the teachings of the present invention will recognize additional modifications and applications within the scope thereof. For example, the teachings of the present invention are not limited to antenna reflectors approximating the conic surfaces described herein. Those skilled in the art may know of other dual reflector geometries amenable to deformation in accordance with the procedure described herein. Moreover, the present invention is not limited to symmetrical reflector geometries nor to antenna systems wherein the antenna feed is positioned on a centered longitudinal axis thereof.

It is therefore contemplated by the appended claims to cover any and all such modifications and embodiments.

Accordingly, what is claimed is:

1. A dual reflector scanning antenna system comprising:

antenna feed means for emitting electromagnetic radiation;

an antenna subreflector including a first surface of a first shape for redirecting said emitted radiation, said subreflector having a longitudinal axis extending perpendicularly through at a rotation point proximate a vertex thereof;

a main antenna reflector including a second surface of a second shape for projecting said radiation from said subreflector as an antenna beam, said main reflector having a main longitudinal axis extending perpendicularly through a point proximate a vertex thereof, said first shape and said second shape being such that a wavefront from said main reflector forms a scan angle with a perpendicular to said main longitudinal axis when the longitudinal axis of said subreflector intersects said main longitudinal axis at an angle approximately equal to one half of said scan angle; and means for rotating said subreflector about said rotation point so as to vary the angular orientation between said main longitudinal axis and the longitudinal axis of said subreflector and thereby scan said antenna beam relative to said main longitudinal axis.

2. The antenna system of claim 1 wherein said first shape approximates a paraboloid symmetrical about said main longitudinal axis and wherein said second shape approximates a hyperboloid symmetrical about said subreflector longitudinal axis.

3. The antenna system of claim 1 wherein said antenna feed means includes a waveguide horn at a feed location intersected by said main longitudinal axis.

4. The antenna system of claim 3 wherein said antenna system has a focal point at said feed location when said subreflector longitudinal axis intersects said main longitudinal axis at a maximum scan angle.

5. A method of generating a scanning antenna beam utilizing a dual reflector scanning antenna system having a main longitudinal axis and a subreflector longitudinal axis comprising the steps of:

a) positioning a source for emitting electromagnetic radiation at a fixed location;

b) redirecting said emitted radiation about a subreflector longitudinal axis;

c) projecting said redirected radiation relative to said main longitudinal axis as an antenna beam having a planar wavefront; and d) varying the angular orientation between said subreflector and main longitudinal axes such that said planar wavefront forms a first angle with a perpendicular to said main longitudinal axis when said subreflector longitudinal axis intersects said main longitudinal axis at approximately one half of said first angle.

6. The method of claim 5 wherein said step of positioning includes the step of selecting said fixed location to be on said main longitudinal axis.

* * * * *